United States Patent [19]

Conti

[11] 4,203,373

[45] May 20, 1980

[54] SHELF DISPLAY SYSTEM

[75] Inventor: Rino Conti, Stoughton, Mass.

[73] Assignee: Dart Industries Inc., Los Angeles, Calif.

[21] Appl. No.: 933,007

[22] Filed: Aug. 11, 1978

[51] Int. Cl.[2] ..... A47B 5/00; A47B 9/00

[52] U.S. Cl. ..... 108/152; 108/13; 108/62; 108/108; 108/110; 248/295 A

[58] Field of Search ..... 108/152, 108, 149, 151, 108/13, 62, 110, 57.1; 248/295 C, 295 A, 220.2, 224.4, 125; 211/88; 297/DIG. 2; 312/247, 246, 245

[56] References Cited

U.S. PATENT DOCUMENTS

| | | | |
|---|---|---|---|
| 438,280 | 10/1890 | Wright | 108/152 |
| 775,184 | 11/1904 | Kuchsmeier | 248/295 C |
| 1,947,165 | 2/1934 | Nelke | 248/295 A |
| 2,150,795 | 3/1939 | Beckwith | 108/152 |
| 3,375,936 | 8/1968 | Kessler | 108/108 X |
| 3,884,525 | 5/1975 | Mesinger | 297/DIG. 2 |
| 4,126,366 | 11/1978 | Handler et al. | 108/152 X |

FOREIGN PATENT DOCUMENTS

| | | | |
|---|---|---|---|
| 1138417 | 6/1957 | France | 108/108 |

*Primary Examiner*—James T. McCall
*Attorney, Agent, or Firm*—Leigh B. Taylor

[57] ABSTRACT

A wall fixture or shelf unit including a rail or bracket having laterally positioned projections and a shelf unit having a slot construction which fits into the projections thereby locking it to the bracket.

2 Claims, 8 Drawing Figures

SHELF DISPLAY SYSTEM

This invention relates to a wall fixture or shelf unit construction and, more particularly to such a construction that may be employed with a single wall mounted rail or bracket assembly. Numerous other systems provide two spaced, parallel, vertical rails, each having a plurality of slots and by providing the shelf or support with mating vanes which fit in a pair of slots, one in each of the two rails. While these constructions are very useful, there are situations where it is desirable to have a shelf element which spans two rails, thereby gaining the stability offered by the double connection. For example, it may be desirable to employ a short shelf which is only wide enough to be attached to one rail. Not only does the lack of stability which is inherent in this arrangement allow the shelf element to reside at an angle to the rail (so that it has a peculiar or unsatisfactory appearance), but, when valuable bric-a-brac are to be carried on such shelf element, instability offers the possibility of the supported item falling on the floor and breaking. These and other difficulties experienced with the prior art devices have been obviated in a novel manner by the present invention.

Furthermore, in those instances where the shelf unit extends between and is supported by a plurality of rails the instant construction provides an inherent lateral stability uncommon to most of the prior art systems.

It is, therefore, a principal objective of the invention to provide a wall fixture including a shelf element mounted on a single vertical rail by means of a slot-and-fin arrangement, so that the unit is stabilized against angular movement of the shelf element relative to the rail.

Another object of this invention is the provision of a wall fixture having a novel connection between a shelf element and a single vertical rail.

It is a further object of the invention to provide a wall fixture of a very adaptable nature, in which the vertical rails may be used in any selected length and number and in which a variety of shelf elements are available for use with the rails, thus permitting the user to select a combination of rails and shelf elements to suit his taste and needs.

Another object of the invention is the provision of a wall fixture consisting of a plurality of elements which are easily dis-assembled for washing or changing.

Another object of the invention is the provision of a wall fixture all of whose elements are capable of being easily and simply manufactured by the injection molding process.

With these and other objects in view, as will be apparent to those skilled in the art, the invention resides in the combination of parts set forth in the specification and covered by the claims appended hereto.

In general, the invention consists of a wall fixture having a rail which is adapted to be fastened to a wall surface in a vertical aspect. The rail is formed with a plurality of laterally positioned projections that incorporate a lip extending from the front to back of the runner section thereof. A shelf element is provided having a vertical rear surface which is adapted to lie against the front surface of the rail and which has a slot extending vertically along the rear surface for locking engagement with corresponding laterally positioned projections in the rail.

More specifically, the shelf unit of the display system includes a rear surface slot having a wall offset from and parallel to the rear surface which wall is interconnected to that surface by two opposed webs. Furthermore, note that the rear surface has opposed extensions which produce a T configuration that is positionable along the rail or bracket in connection with the lateral projection and lips.

These and other objectives and advantages will become more apparent upon reference to the continuing specification, drawings and claims appended hereto, and wherein:

Figure 1:
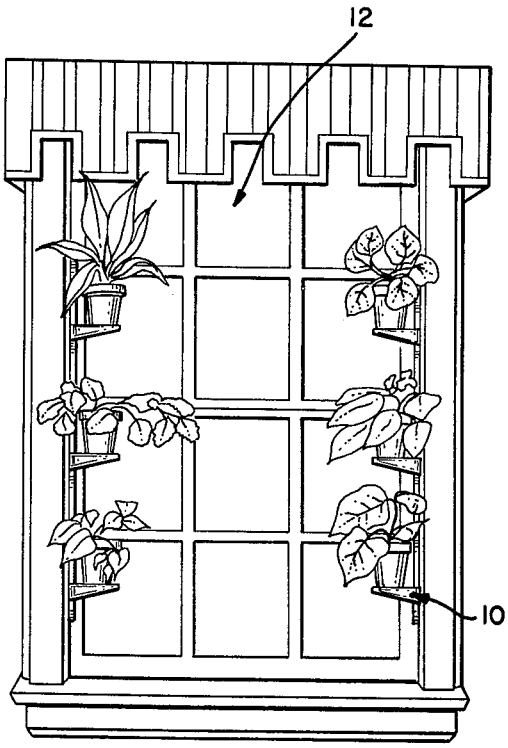
FIG. 1 is a front elevational view of a typical cord and sash window within which have been mounted shelf units of the instant invention.

Referring now to the various drawing FIGS., and more particularly to FIG. 1, wherein the shelf display system or wall fixture of the instant invention is identified by the reference numeral 10, it will become readily apparent that the concept thereof, although not limited to, is primarily adapted to smaller shelving unit application employing a single bracket support means for the shelves per se. Such systems have application in more restricted areas around the home such as is there illustrated by the framed window area 12.

Figure 2:
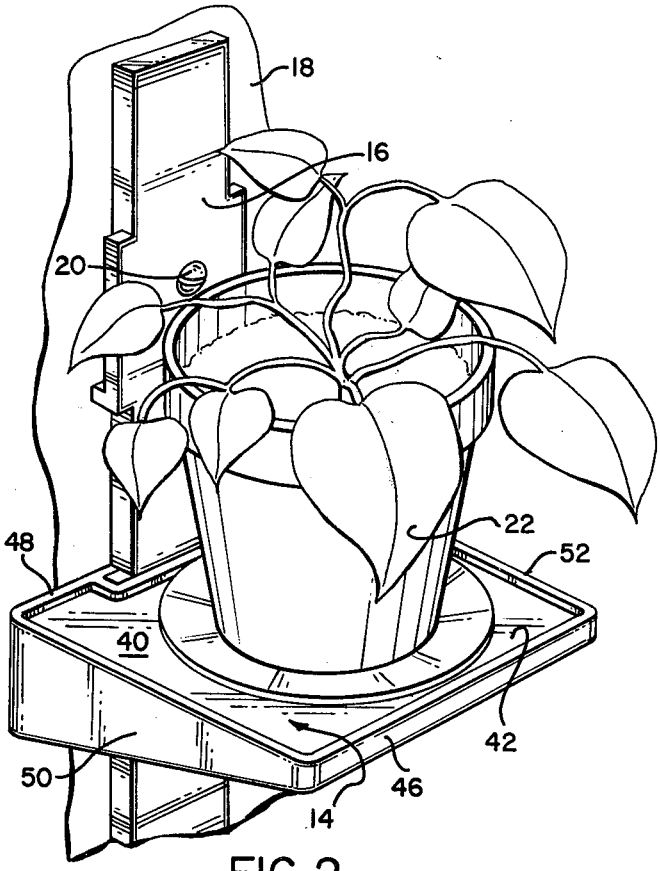
FIG. 2 is an enlarged view of a portion of the shelf unit including its rail support.

The display system 10 is created by two principal elements, a shelf unit 14 and a bracket or rail 16. As is typical with this type of wall fixture the bracket 16 is adapted to be mounted to a vertically extending surface 18 (FIG. 2) by means of screws 20 or some other suitable holding means. The shelf units 14 are positioned along the rail 16 so as to provide a supporting means for plants 22 or any other bric-a-brac or similar display items.

FIGS. 3–8 more specifically detail the display system construction which makes a unique contribution to this kind of arrangement. The rail or bracket 16 is comprised of an elongate runner portion 24 having side sections 26, a frontal surface 28 and a recessed back surface 30. Spaced along the side sections 26 are opposed laterally positioned projections 32 and horizontally disposed lips 34 the purposes of which will be discussed in more detail hereinafter.

In order to secure rail or bracket 16 to its mounting surface 18, apertures 36 extending between surfaces 28 and 30 are provided at spaced locations along runner portion 24. Such apertures may take any form that will suitably accommodate the type of fastener that is to be employed in the system, however, it is preferred that counter-sinks be provided on the runner frontal surface 28. Likewise, since in the preferred embodiment, the runner portion 24 is recessed along its back wall bosses 38 (FIG. 6) are provided at and surround the apertures 36 location so as to fully and adequately support the runner at its points of attachment to surfaces 18. Furthermore, note that the apertures 36 are located between opposed projections 32 so that the exposed fastener head 20 can be concealed by a shelf unit 14 if so desired.

Figure 3:
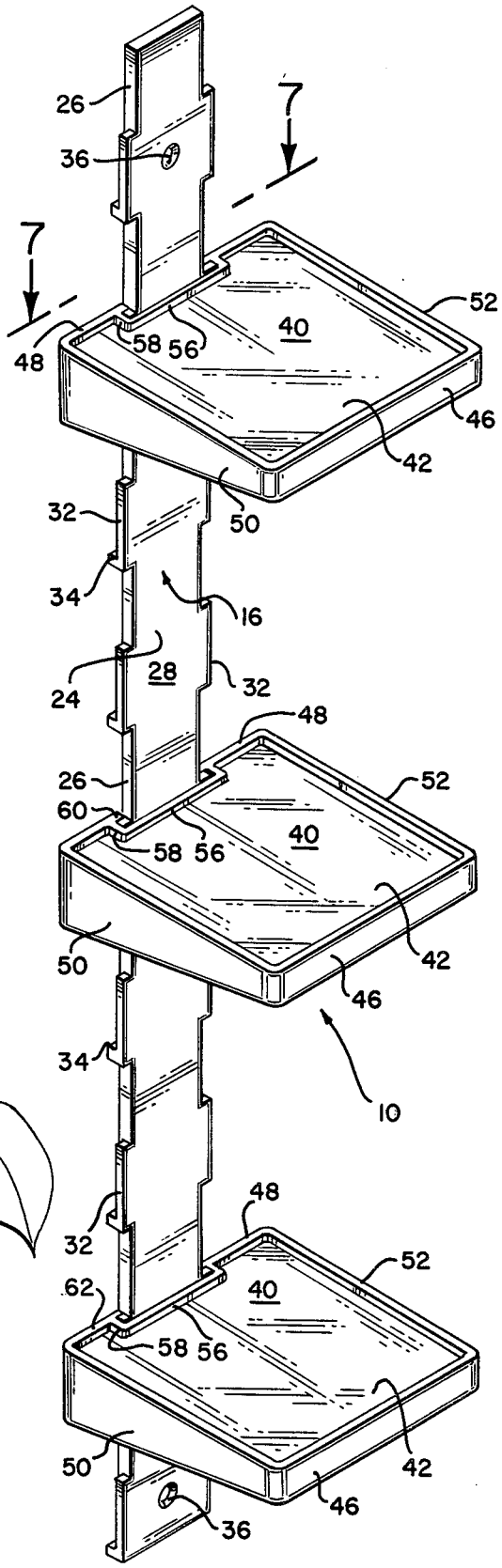
FIG. 3 is a top-front perspective view of the wall fixture of the instant invention illustrating a plurality of shelf units positioned variously along the bracket support.
Figure 4:
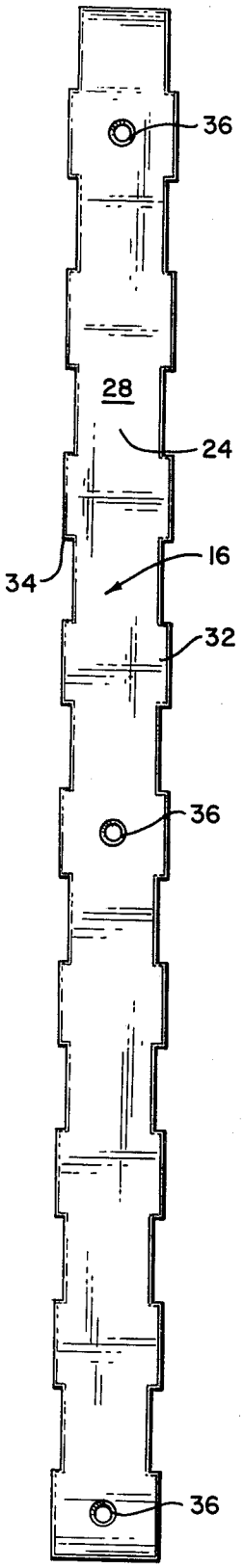
FIG. 4 is a front elevational view of the wall fixture bracket.
Figure 5:
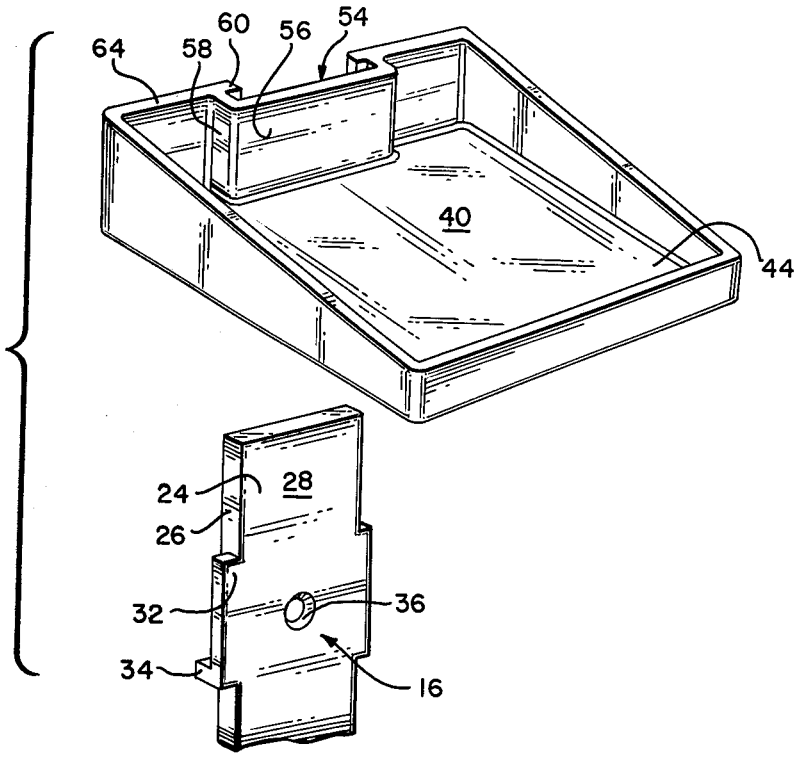
FIG. 5 is a partial exploded bottom-front perspective view of the wall fixture illustrating the reversible feature of the shelf unit.
Figure 6:
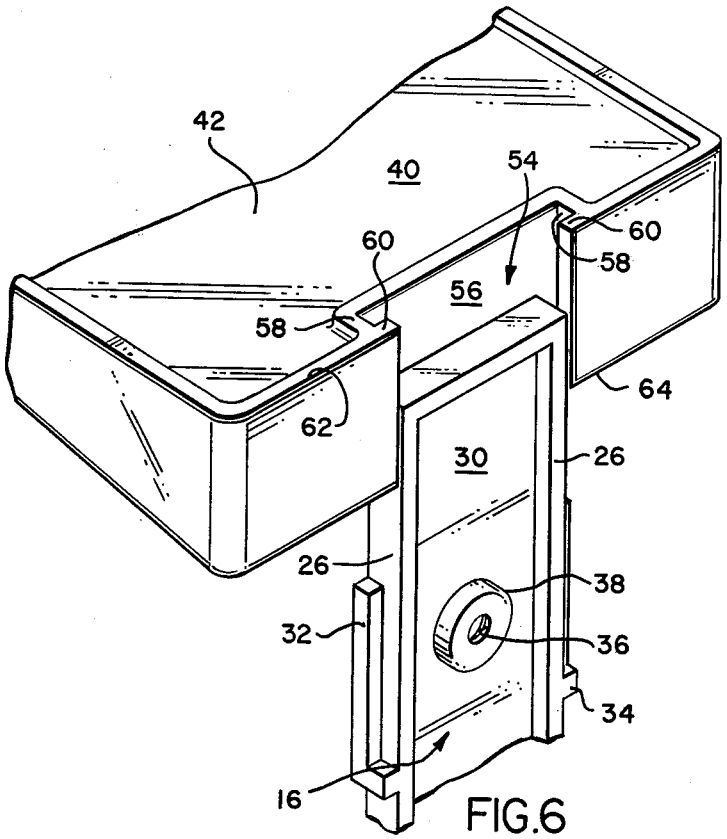
FIG. 6 is partial exploded top-rear perspective view of the shelf unit.
Figure 7:
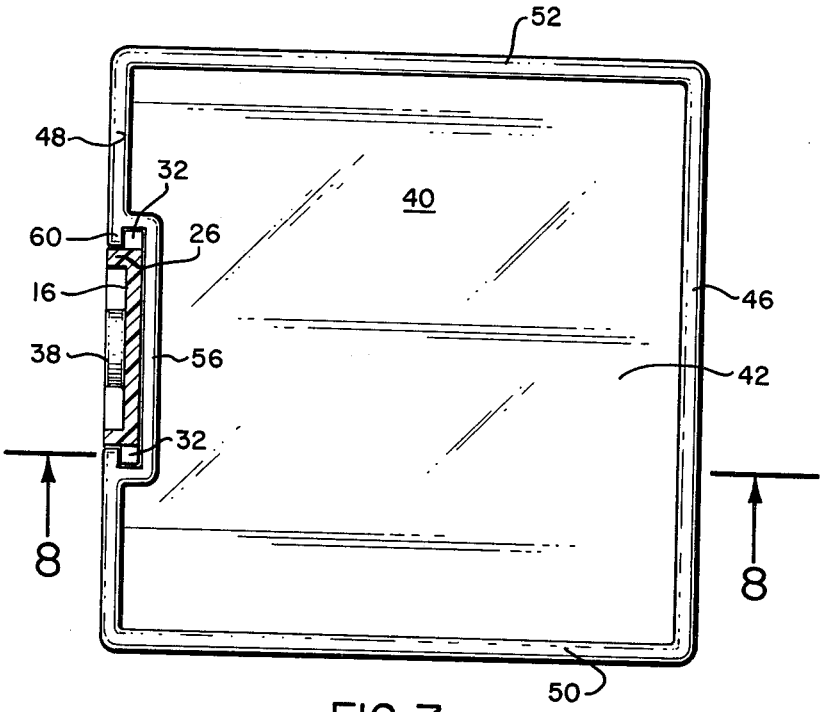
FIG. 7 is a cross-sectional view taken along line 7—7 of FIG. 3.
Figure 8:
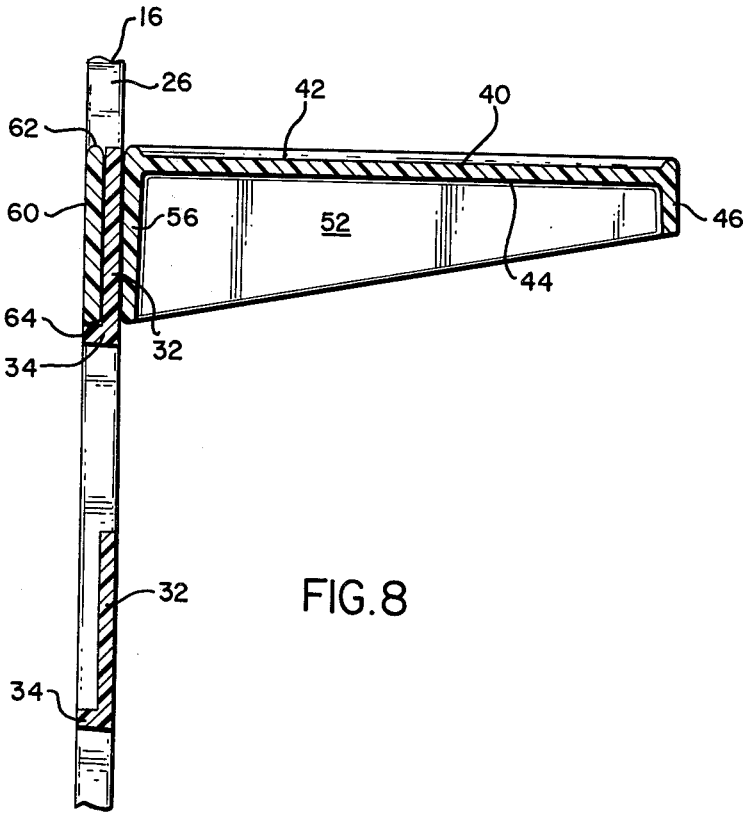
FIG. 8 is a cross-sectional view taken along line 8—8 of FIG. 7.

The shelf units or trays 14, as is readily apparent from FIG. 3 are positionable at a variety of selected positions along rail 16 and are constructed for rigid interconnection therewith. Such shelves include a substantially planar member 40 having opposite exposed supporting surfaces 42, 44. Planar member 44 is further bounded by a plurality of side wall elements 46, 48, 50 and 52 which are adapted to protrude above surfaces 42, 44 in a generally vertical manner. Furthermore, their protrusion or projection above surface 44, as can best be seen in FIG. 5, produces a relatively deep well-like construction whereas there is only a slight projection above surface 42.

In order for the shelf units 14 to be stabilly and effectively retained on rail 16, a slot 54 (FIGS. 5 and 6) is formed along wall 48 between its top edge 62 and bottom edge 64 by means of offset wall 56 that is interconnected with wall 48 by webs 58. The slot 54 is completed by the opposed side extensions 60 of wall 48 thus creating a T configuration that slips over and behind rail projections 32 and abuts lips 34. Likewise, note that the mentioned projections 32 and lips 34 are edge positioned along rail 16 and thereby have a lateral separation of an extent that provides the rigid support spoken of.

Although the invention has been described above in terms of a single rail supporting arrangement, it should be understood that various deviations may be made from this preferred embodiment such that multiple rails might be employed with brackets having integral or removable shelving. Furthermore, it should be apparent that the shelf units 18 might take any one of a variety of shapes dependent upon the surface area to which it might be intended to be attached.

We claim:

1. A shelf display system adapted to be wall mounted and including a bracket having at least one pair of laterally positioned projections protruding therefrom each projection incorporating at one end thereof a lip, a reversible shelf unit including a substantially planar member bounded by extended side wall elements, said elements projecting well above one surface of the member and having at least one slot of a T configuration along one side thereof, said slot being engaged and retained upon the bracket by said projections and lips.

2. A shelf display system as set forth in claim 1 wherein said bracket is comprised of an elongate runner portion having side edge sections from which said laterally positioned projections and lips protrude, said runner portion including frontal surface and a recessed back surface with at least one aperture extending therebetween and wherein, at least one boss integral with said runner and protruding from said back surface surrounds said at least one aperture.

* * * * *